US009016927B2

(12) United States Patent
Kuriki et al.

(10) Patent No.: US 9,016,927 B2
(45) Date of Patent: Apr. 28, 2015

(54) CLAY MIXING APPARATUS

(75) Inventors: Motoki Kuriki, Kyoto (JP); Takeo Tokuda, Kyoto (JP); Masaya Higashitsuji, Kyoto (JP)

(73) Assignee: Nidec-Shimpo Corporation, Kyoto (JP)

( * ) Notice: Subject to any disclaimer, the term of this patent is extended or adjusted under 35 U.S.C. 154(b) by 4 days.

(21) Appl. No.: 13/432,099

(22) Filed: Mar. 28, 2012

(65) Prior Publication Data

US 2012/0250447 A1 Oct. 4, 2012

(30) Foreign Application Priority Data

Mar. 29, 2011 (JP) ..... 2011-073105

(51) Int. Cl.

| | |
|---|---|
| ***B28C 1/16*** | (2006.01) |
| ***B01F 7/00*** | (2006.01) |
| ***B01F 7/04*** | (2006.01) |
| ***B01F 13/06*** | (2006.01) |
| ***B01F 15/02*** | (2006.01) |
| ***B28B 3/22*** | (2006.01) |
| ***B28C 1/22*** | (2006.01) |
| ***B28C 5/14*** | (2006.01) |

(52) U.S. Cl.

CPC ..... *B28C 1/16* (2013.01); *B01F 7/00133* (2013.01); *B01F 7/00158* (2013.01); *B01F 7/003* (2013.01); *B01F 7/00708* (2013.01); *B01F 7/04* (2013.01); *B01F 13/06* (2013.01); *B01F 15/0289* (2013.01); *B28B 3/222* (2013.01); *B28C 1/225* (2013.01); *B28C 5/143* (2013.01)

(58) Field of Classification Search

CPC ..... B28C 1/16

USPC ..... 366/139, 181.4–181.5, 184, 186, 328.2, 366/328.1

See application file for complete search history.

(56) References Cited

U.S. PATENT DOCUMENTS

| | | | | |
|---|---|---|---|---|
| 1,809,160 | A * | 6/1931 | Coste | 366/81 |
| 2,078,565 | A * | 4/1937 | Durst et al. | 366/75 |
| 2,567,523 | A * | 9/1951 | Moore | 366/81 |
| 3,942,774 | A * | 3/1976 | Sokolow | 366/77 |
| 3,946,996 | A * | 3/1976 | Gergely | 366/139 |
| 4,322,169 | A | 3/1982 | Wood | |
| 4,763,569 | A * | 8/1988 | Wenger et al. | 99/348 |
| 5,716,130 | A | 2/1998 | Wood | |
| 6,076,954 | A * | 6/2000 | Gisko | 366/139 |
| 8,011,823 | B2 | 9/2011 | Suzuki | |
| 2006/0231473 | A1 * | 10/2006 | Taniguchi | 210/219 |

(Continued)

FOREIGN PATENT DOCUMENTS

| | | |
|---|---|---|
| CN | 1146393 A | 4/1997 |
| CN | 201597119 U | 10/2010 |

(Continued)

*Primary Examiner* — David Sorkin

(74) *Attorney, Agent, or Firm* — Keating & Bennett, LLP

(57) ABSTRACT

A clay mixing apparatus includes a mixing chamber, a rotor arranged within the mixing chamber, a drive unit arranged to rotate the rotor, an ejecting unit, a pressure reducing unit; and an exhaust flow path. The rotor includes a shaft rotated by the drive unit, an extruding member and a mixing member. The mixing member includes a plurality of arms and a plurality of blades arranged at tip ends of the arms. The exhaust opening is opposed, in a radial direction about the center axis, to a portion of the mixing member lying near the extruding member and/or a portion of the extruding member lying near the mixing member.

20 Claims, 12 Drawing Sheets

(56) References Cited

U.S. PATENT DOCUMENTS

2007/0280038 A1* 12/2007 Schmidt et al. ..... 366/139
2008/0025143 A1* 1/2008 Ohashi et al. ..... 366/181.4

FOREIGN PATENT DOCUMENTS

JP 55-39830 U 3/1980
JP 07-214537 A 8/1995

* cited by examiner

CLAY MIXING APPARATUS

BACKGROUND OF THE INVENTION

1. Field of the Invention

The present invention relates to a clay mixing apparatus for mixing clay.

2. Description of the Related Art

Conventionally, there has been used a clay mixing apparatus suitable for mixing clay to manufacture a piece of earthenware. If an air remains within the clay for the manufacture of earthenware, crack or breakage may occur in a biscuit firing step. In light of this, a variety of studies has been made in the field of clay mixing apparatus. For example, Japanese Patent Application Publication No. H7-214537 discloses a clay mixing apparatus in which an air is discharged from a mixing chamber by virtue of a vacuum suction device. Referring to FIG. 6 of Japanese Patent Application Publication No. H7-214537, a suction pipe is arranged at the rear side of the top of a lid in order to efficiently circulate the clay.

U.S. Pat. No. 5,716,130 discloses a clay mixing apparatus in which a vacuum chamber is connected to a tubular vessel. A shaft is arranged to extend from the vacuum chamber toward the tubular vessel. The shaft is inserted into an opening of a wall existing between the vacuum chamber and the tubular vessel. A gap is left between the shaft and the wall. A plurality of blades is attached to the shaft. A helical portion is provided at the tip end of the shaft. The blades axially overlap with one another. In operation, materials are mixed within a mixing chamber as if the shaft rotates. After a specified time has lapsed, the vacuum chamber is evacuated through the opening of the wall. Then the shaft is rotated in the reverse direction, whereby the clay is extruded from an extruding and molding portion under the action of the helical portion.

Within the mixing chamber, the clay having an increased viscosity is mixed with a strong force. For that reason, the clay adheres to different areas within the mixing chamber. In order to prevent the clay from adhering to the opening for evacuation, there is a need to form the mixing chamber into an upwardly enlarged shape as in the clay mixing apparatus of Japanese Patent Application Publication No. H7-214537. In this structure, however, the size of the clay mixing apparatus grows larger. In case of the clay mixing apparatus disclosed in U.S. Pat. No. 5,716,130, it is necessary to install a complex mechanism around the shaft. In addition, it is impossible to readily remove the clay infiltrating into the vacuum chamber.

The clay, when stirred with large blades, is not finely cut. This makes it impossible to rapidly remove an air from the clay.

When extruding the mixed clay through the use of a helical screw, the clay is rotationally extruded under the influence of the rotation of the screw. As a consequence, the clay is extruded in a distorted state if a molding portion for molding the clay into a shape other than the circular shape is attached to the extrusion hole.

SUMMARY OF THE INVENTION

It is required for a clay mixing apparatus to readily discharge an air from a mixing chamber. It is also required for a clay mixing apparatus to efficiently remove the air contained in the clay during a kneading process. It is further required for a clay mixing apparatus to suppress distortion of the clay during an extruding process.

In accordance with a first embodiment of the present invention, there is provided a clay mixing apparatus including a mixing chamber, a rotor, a drive unit, an ejecting unit having a conical inner circumferential surface, a pressure reducing unit and an exhaust flow path. The mixing chamber has a substantially cylindrical inner circumferential surface. The mixing chamber has a center axis extending in a horizontal direction. The rotor is arranged within the mixing chamber and has a first end portion as a supported end portion and a second end portion positioned opposite to each other in a direction along the center axis. The drive unit is connected to the first end portion of the rotor. The drive unit serves to rotate the rotor about the center axis. The ejecting unit is arranged to surround the second end portion of the rotor. The ejecting unit has an ejection hole defined at a tip end thereof. The diameter of the conical inner circumferential surface is reduced away from the drive unit. The exhaust flow path is arranged to connect the pressure reducing unit to an exhaust opening opened into the mixing chamber. The rotor includes a shaft, an extruding member and a mixing member. The shaft is arranged to extend along the center axis and is rotated by the drive unit. The extruding member is provided with a screw inclined in a first direction with respect to a circumferential direction about the center axis. The mixing member includes a plurality of arms and a plurality of blades. The arms extend from the shaft toward the cylindrical inner circumferential surface. The blades are arranged at tip ends of the arms and are inclined in a first direction with respect to a circumferential direction. The exhaust opening is opposed, in a radial direction about the center axis, to a portion of the mixing member lying near the extruding member and/or a portion of the extruding member lying near the mixing member.

With such configuration, it is possible to easily reduce the internal pressure of the mixing chamber.

In accordance with a second embodiment of the present invention, there is provided a clay mixing apparatus including a mixing chamber, a rotor, a drive unit, a pressure reducing unit and an exhaust flow path. The mixing chamber has a substantially cylindrical inner circumferential surface whose center axis extends in a horizontal direction. The rotor is arranged within the mixing chamber and has a supported end portion extending along a center axis direction. The drive unit is connected to the first end portion of the rotor and is arranged to rotate the rotor about the center axis. The exhaust flow path is arranged to interconnect mixing chamber and the pressure reducing unit. The rotor includes a shaft and a mixing member. The shaft is arranged to extend along the center axis and is rotated by the drive unit. The mixing member is arranged on the shaft. The mixing member includes a plurality of arms and a plurality of blades. The arms extend from the shaft toward the cylindrical inner circumferential surface. The blades are arranged at tip ends of the arms and are inclined in a first direction with respect to a circumferential direction. At least one of the blades has a plurality of through-holes or a plurality of slits through which clay passes during a mixing process.

With such configuration, it is possible to efficiently remove the air contained in the clay during a mixing process.

In accordance with a third embodiment of the present invention, there is provided a clay mixing apparatus including a mixing chamber, a rotor, a drive unit and an ejecting unit having a conical inner circumferential surface. The rotor is arranged within the mixing chamber and has a first end portion as a supported end portion extending in a center axis direction and a second end portion positioned opposite to the first end portion. The drive unit is connected to the first end portion of the rotor and is arranged to rotate the rotor about the center axis. The ejecting unit is arranged to surround the second end portion of the rotor. The ejecting unit has a tip end and an ejection hole defined at the tip end. The diameter of the conical inner circumferential surface is reduced away from the drive unit. The rotor includes a shaft, an extruding member and a mixing member having a screw. The shaft is arranged to extend along the center axis and is rotated by the drive unit. The extruding member is arranged on the shaft in the second end portion of the rotor. The screw is inclined in a first direction with respect to a circumferential direction about the center axis. The mixing member is arranged on the shaft between the extruding member and the first end portion of the rotor. The ejecting unit includes a first clay-ejecting inner circumferential surface and a second clay-ejecting inner circumferential surface. The first clay-ejecting inner circumferential surface extends from the conical inner circumferential surface toward the ejection hole. The second clay-ejecting inner circumferential surface is positioned between the first clay-ejecting inner circumferential surface and the ejection hole. The first clay-ejecting inner circumferential surface has a plurality of recess portions or raised portions. The recess portions or the raised portions extend parallel to the center axis and are arranged along the circumferential direction. The first clay-ejecting inner circumferential surface has an innermost diameter equal to or greater than an inner diameter of the second clay-ejecting inner circumferential surface.

With such configuration, it is possible to restrain distortion of the ejected clay.

The above and other elements, features, steps, characteristics and advantages of the present invention will become more apparent from the following detailed description of the preferred embodiments with reference to the attached drawings.

DETAILED DESCRIPTION OF PREFERRED EMBODIMENTS

Figure 1:
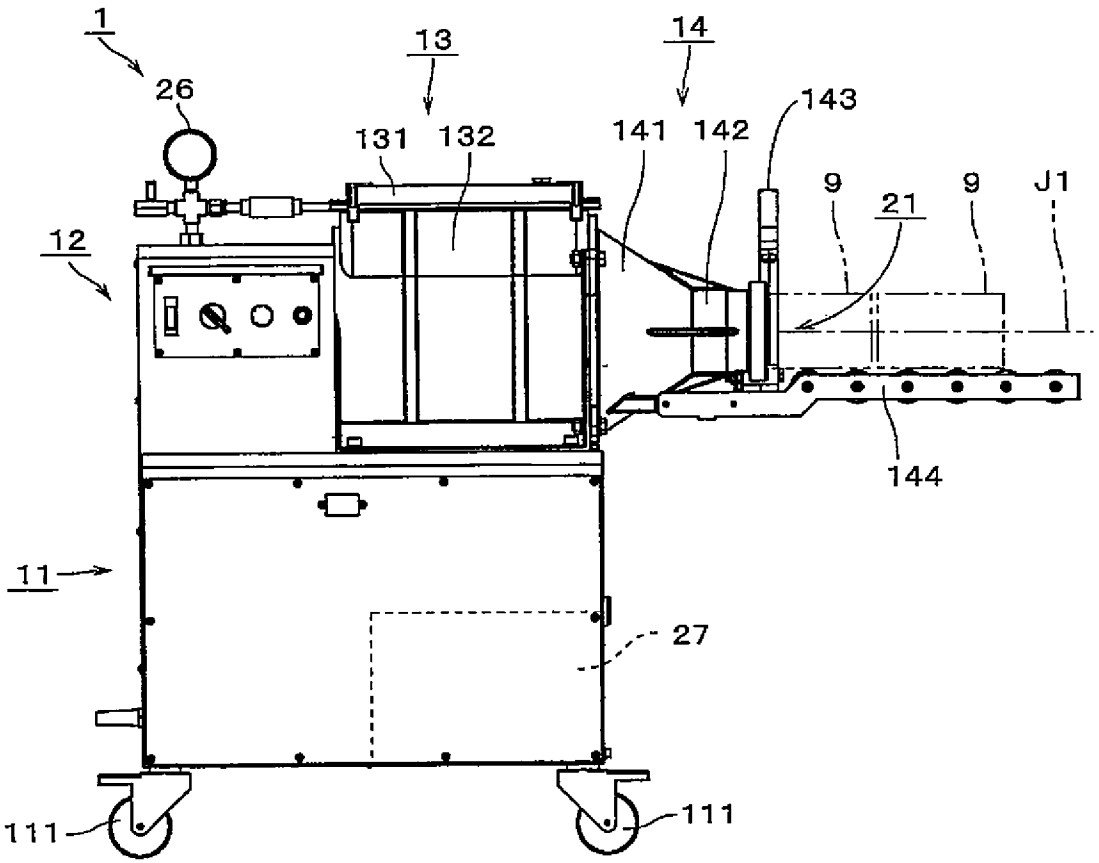
FIG. 1 is a front view showing a clay mixing apparatus in accordance with an embodiment of the present.
Figure 2:
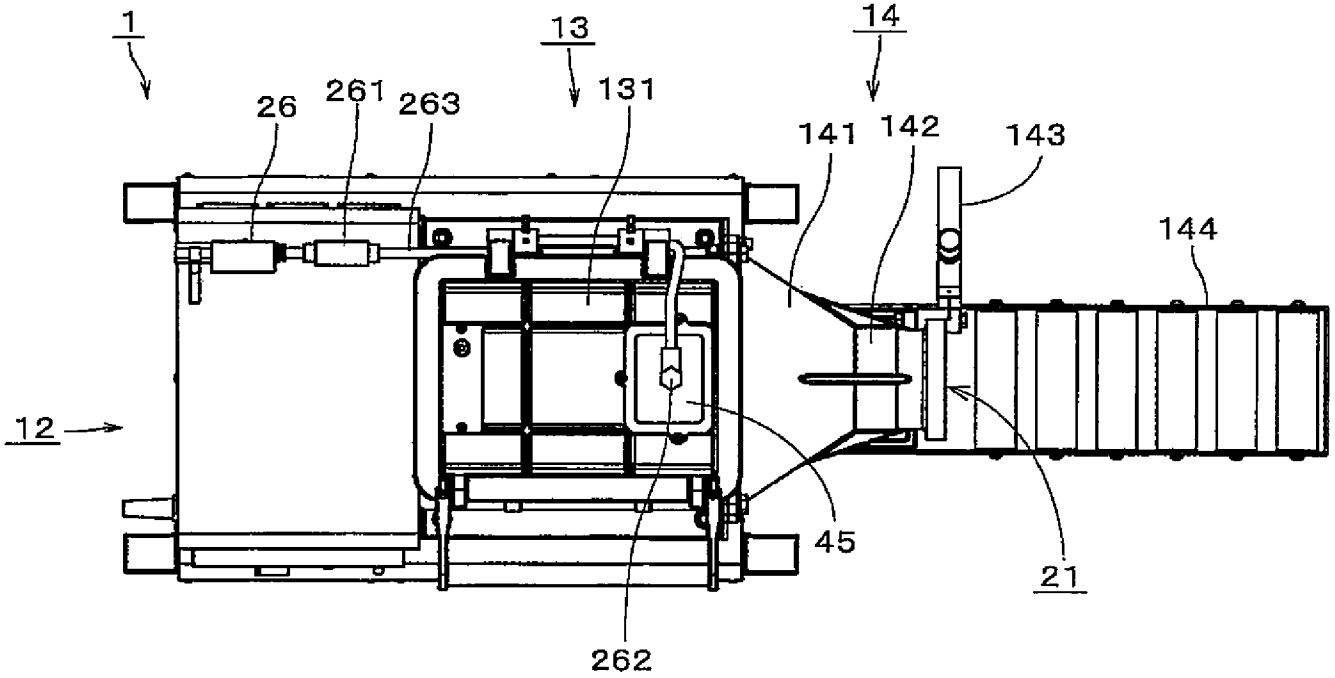
FIG. 2 is a plan view of the clay mixing apparatus.
Figure 3:
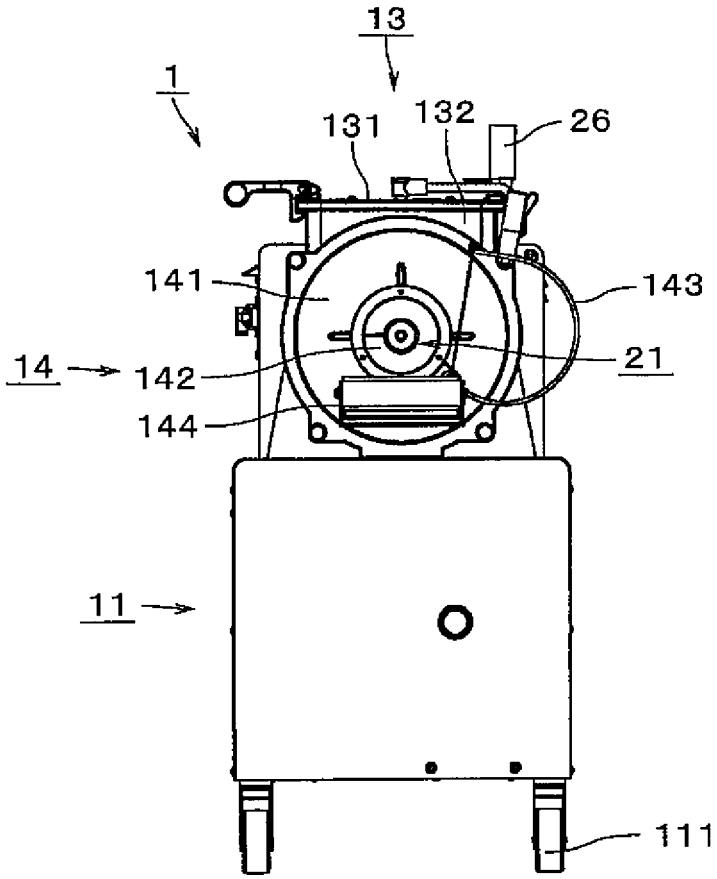
FIG. 3 is a left side view of the clay mixing apparatus.
Figure 4:
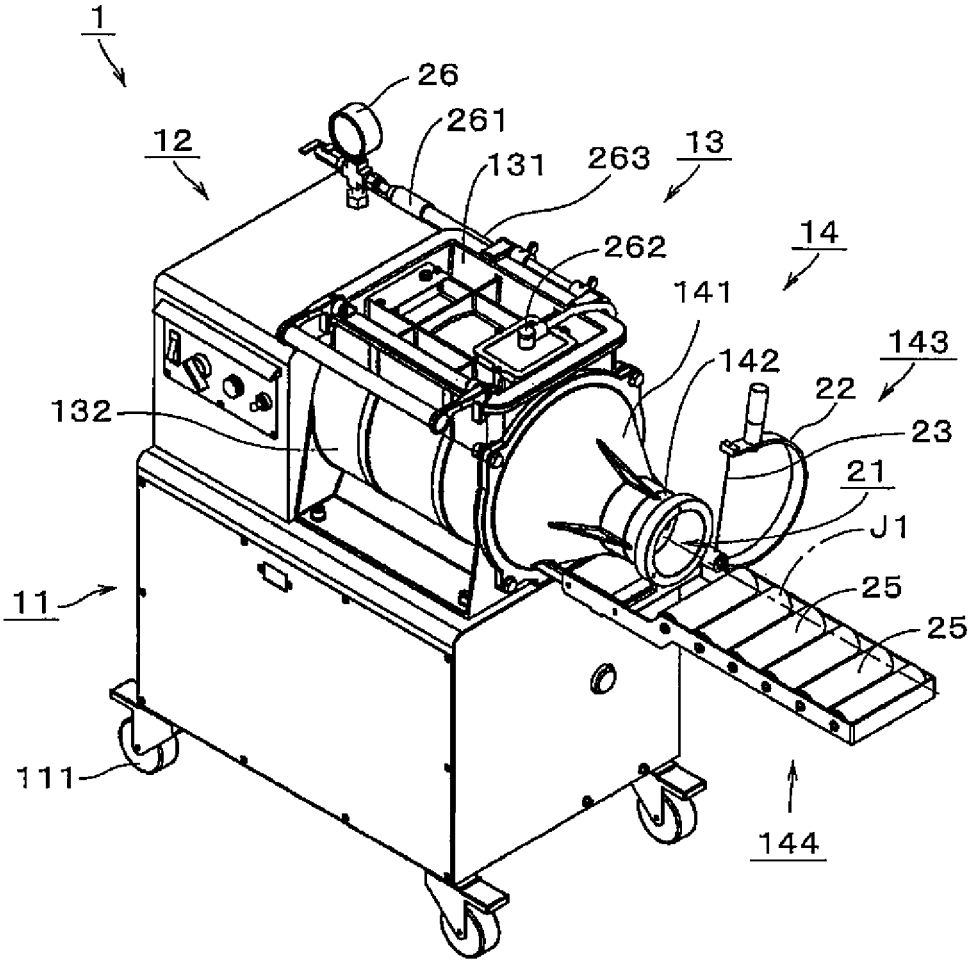
FIG. 4 is a perspective view of the clay mixing apparatus.
Figure 5:
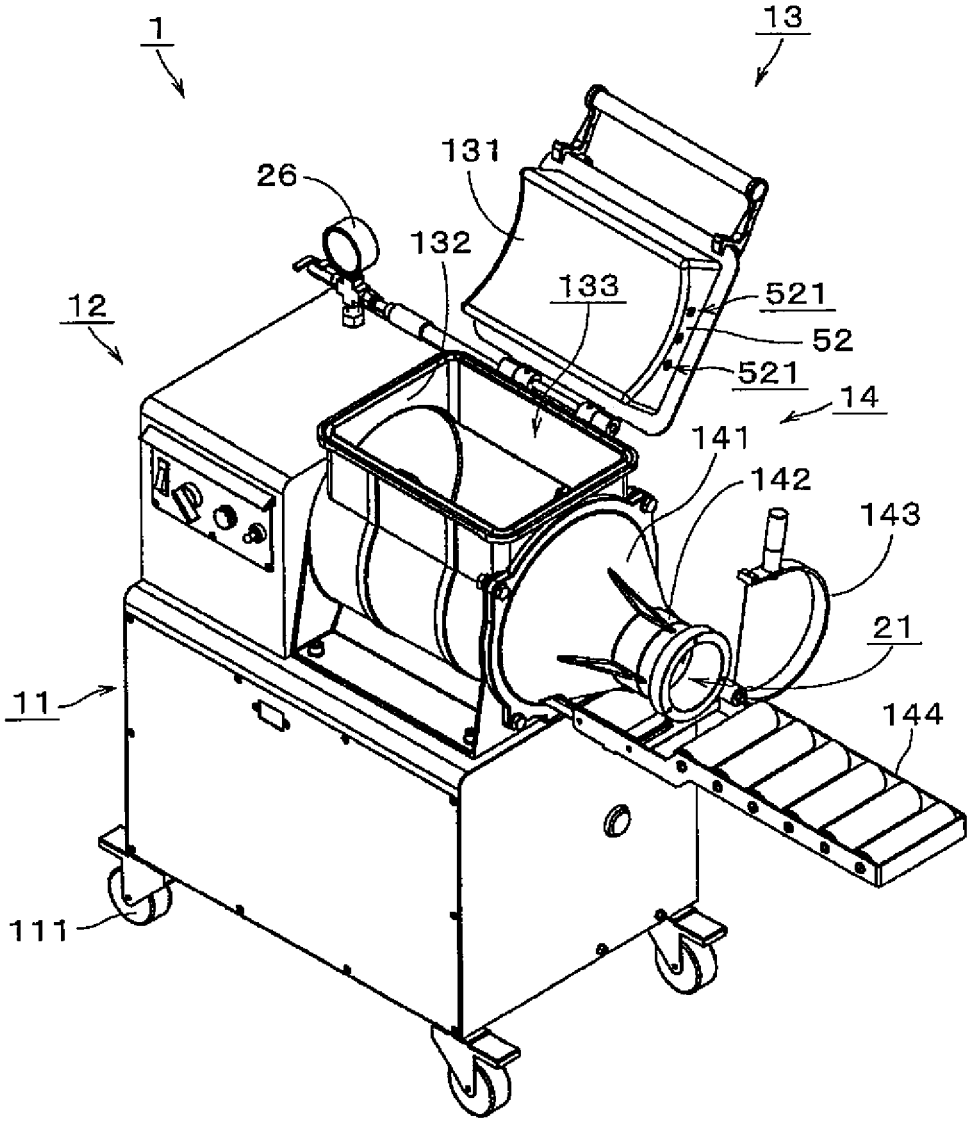
FIG. 5 is a perspective view of the clay mixing apparatus with a body lid kept opened.

FIG. 1 is a front view showing a clay mixing apparatus 1 according to an illustrative embodiment of the present invention. FIG. 2 is a plan view of the clay mixing apparatus. FIG. 3 is a left side view of the clay mixing apparatus. FIG. 4 is a perspective view of the clay mixing apparatus. FIG. 5 is a perspective view of the clay mixing apparatus with a body lid kept opened.

The clay mixing apparatus 1 preferably includes a base 11, an operation unit 12, a mixing chamber 13 and an ejecting unit 14. The base 11 has a box-like shape and accommodates therein mechanisms and electric circuits which are needed to operate the clay mixing apparatus 1. Casters 111 are attached to the lower portion of the base 11. This makes it possible to easily move the clay mixing apparatus 1. The operation unit 12 preferably includes a power switch, a rotation direction, a rotation speed dial and so forth. As will be set forth later, a rotor rotating about a horizontal axis is provided within the mixing chamber 13 and the ejecting unit 14. The center axis about which the rotor rotates will be just referred to as "center axis" herein below. The center axis extends in the left-right direction in FIG. 1 and the extension line of the center axis is designated by reference symbol J1 in FIGS. 1 and 4. The rotation direction and the rotation speed of the rotor are changed by operating the operation unit 12.

The mixing chamber 13 preferably includes an inner circumferential surface formed into a cylindrical shape about the center axis J1. An openable body lid 131 is provided in the upper portion of the mixing chamber 13. The portion of the mixing chamber 13 other than the body lid 131 will be referred to as "mixing chamber body 132" herein below. As shown in FIG. 5, the body lid 131 is connected to the mixing chamber body 132 through hinges and is opened by rotating the same about the hinges. The ejecting unit 14 preferably includes a cone portion 141, an ejection tip end portion 142, a cutting portion 143 and a clay table portion 144. The cone portion 141 is preferably formed into a substantially conical shape about the center axis J1. The diameter of the cone portion 141 is gradually reduced toward the right side in FIG. 1. The ejection tip end portion 142 is preferably formed into a substantially cylindrical shape to protrude from the cone portion 141 toward the right side. The ejection tip end portion 142 preferably includes an ejection hole 21 formed at the tip end thereof. The molded clay is extruded from the ejection hole 21. The cutting portion 143 is provided adjacent to the ejection hole 21.

As shown in FIG. 4, the cutting portion 143 preferably includes a substantially arc-shaped frame 22 and a wire 23. The wire 23 is attached to the frame 22 just like a string. The frame 22 is rotatable about an axis substantially parallel to the center axis J1. As the frame 22 and the wire 23 are rotated across the ejection hole 21, the extruded clay 9 is cut as indicated by double-dot chain lines in FIG. 1.

The clay table portion 144 is positioned below the ejection tip end portion 142 and extends from the cone portion 141 along the ejecting direction. As shown in FIG. 4, the clay table portion 144 preferably includes a plurality of rollers 25 arranged side by side along the ejecting direction. Each of the rollers 25 is rotatable about a horizontal axis substantially orthogonal to the center axis J1. The extruded clay 9 is smoothly guided and is supported from below by the rollers 25. The clay table portion 144 can be swung about a connection position where the clay table portion 144 is connected to the cone portion 141. While the clay mixing apparatus 1 is not in use, the clay table portion 144 is kept in such a state as to extend downward. This makes it possible to reduce the storage space of the clay mixing apparatus 1.

A vacuum gauge 26 is arranged above the operation unit 12. As shown in FIGS. 2 and 4, the joint portion 261 of the vacuum gauge 26 and the joint portion 262 of the body lid 131 are interconnected by a flexible tube 263. The joint portion 262 may be, e.g., an air-filter. The vacuum gauge 26 is connected to a vacuum pump 27 as a pressure reducing unit arranged within the base 11. As the vacuum pump 27 comes into operation, the internal spaces of the mixing chamber 13 and the ejecting unit 14 are depressurized to a vacuum degree of 0.09 MPa or more on the basis of the atmospheric pressure (namely, −0.09 MPa or less when the atmospheric pressure is 0 Pa).

Figure 6:
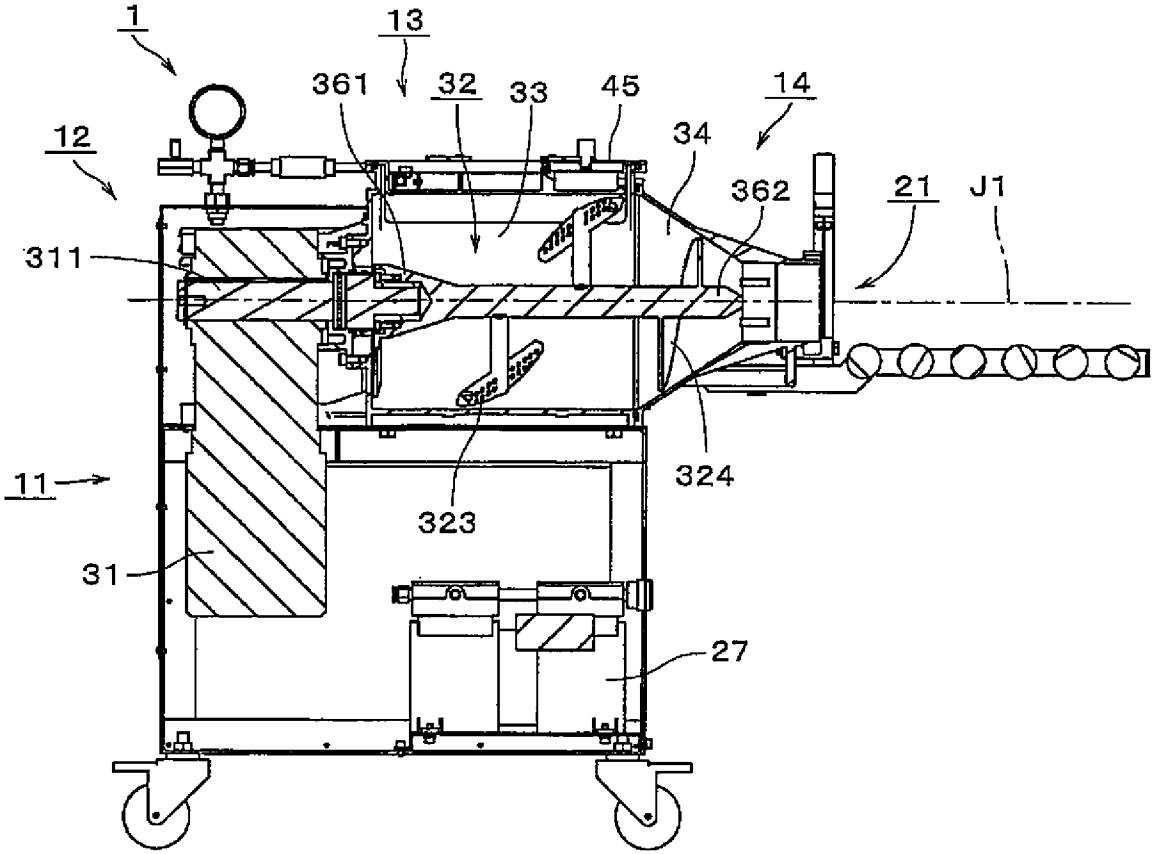
FIG. 6 is a section view of the clay mixing apparatus.

FIG. 6 is a vertical section view of the clay mixing apparatus 1 taken along a plane containing the center axis J1. A geared motor 31 (hereinafter just referred to as "motor 31") is provided within the base 11 and the operation unit 12. A rotor 32 is arranged within the mixing chamber 13. A first end portion 361 of the rotor 32 is connected to and supported by the rotation shaft 311 of the motor 31 within the mixing chamber 13. The first end portion 361 will be referred to as "supported end" herein below. A second end portion 362 of the rotor 32 is not supported. The second end portion 362 will be referred to as "free end" herein below. The drive unit for rotating the rotor 32 about the center axis J1 is not limited to the motor 31 but may be other mechanisms such as a thermal engine and the like.

Figure 7:
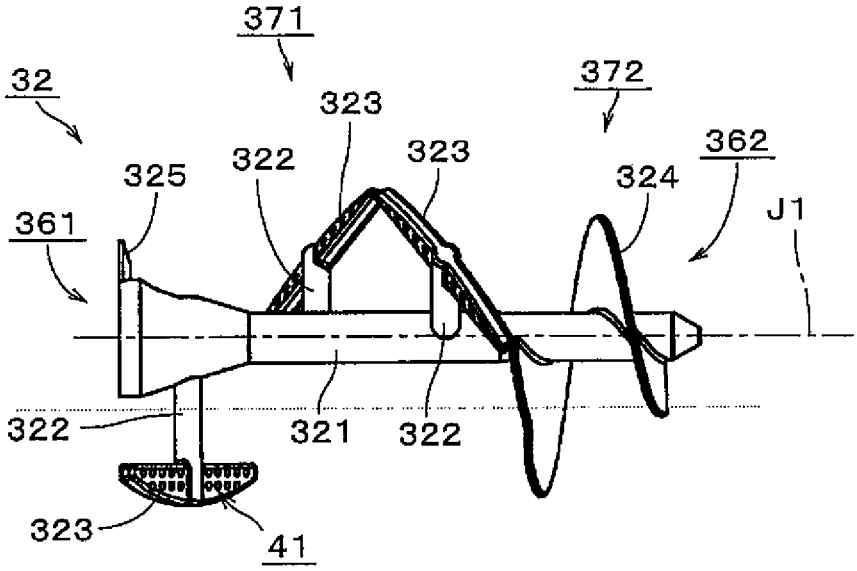
FIG. 7 is a front view showing a rotor.
Figure 8:
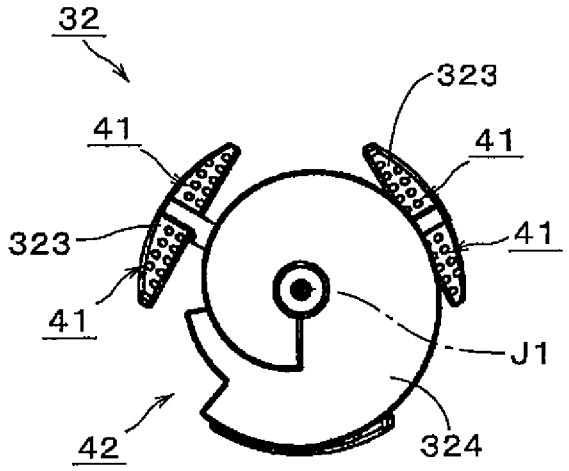
FIG. 8 is a left side view of the rotor.
Figure 9:
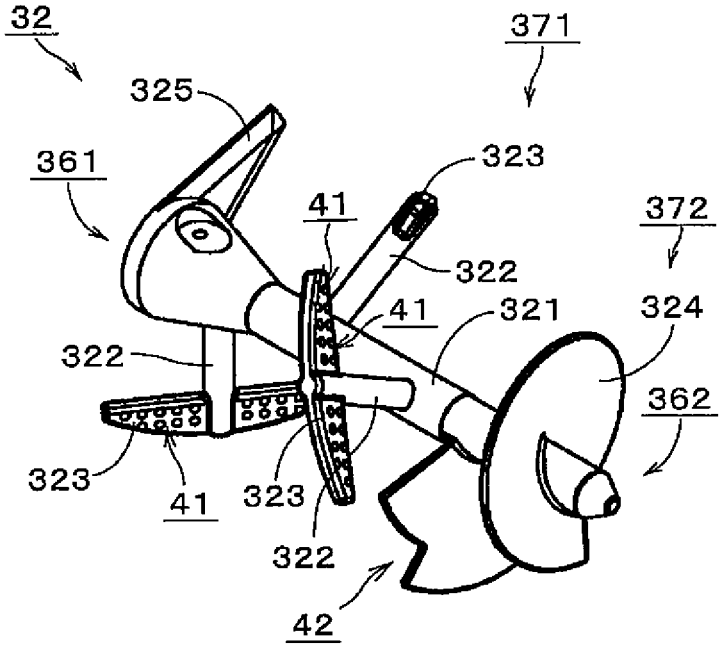
FIG. 9 is a perspective view of the rotor.

FIG. 7 is a front view of the rotor 32. FIG. 8 is a right side view thereof. FIG. 9 is a perspective view thereof. The rotor 32 preferably includes a shaft 321, a plurality of arms 322, a plurality of blades 323, a screw 324 and a vane portion 325. The shaft 321 is arranged to extend along the center axis J1. The shaft 321 is rotated about the center axis J1 by the motor 31. The arms 322 extend from the shaft 321 toward the cylindrical inner circumferential surface 33 of the mixing chamber 13 (hereinafter referred to as "cylindrical inner circumferential surface") shown in FIG. 6. The center axis J1 serves as the center axis of the cylindrical inner circumferential surface 33. The blades 323 extend from the tip ends of the arms 322 in the directions substantially orthogonal to the extension directions of the arms 322. In the present embodiment, the number of the arms 322 and the number of the blades 323 are three, respectively.

A plurality of through-holes 41 are formed in the blades 323. As shown in FIG. 8, the tip end of each of the blades 323 has an arc shape when the blades 323 are seen in the direction substantially parallel to the center axis J1. The edge of each of the blades 323 facing toward the shaft 321 has a rectilinear shape. In this manner, the blades 323 are spaced apart from the shaft 321. The tip ends of the blades 323 are adjacent to the cylindrical inner circumferential surface 33. More specifically, the tip ends of the blades 323 are spaced a distance of about 1 to 5 mm away from the cylindrical inner circumferential surface 33. In the present embodiment, the distance is about 3 mm. When seen at the tip end side of the arms 322, each of the blades 323 is inclined counterclockwise with respect to the circumferential direction about the center axis J1 (hereinafter just referred to as "circumferential direction"). The existence extents of the tip ends of the blades 323 are continuous in the direction of the center axis J1 (hereinafter just referred to as "axial direction"). In other words, the axial existence extents of the blades 323 slightly overlap with each other in the axial direction.

The screw 324 has a helical shape continuously extending in the axial direction. The outer diameter of the screw 324 is gradually reduced toward the free end of the shaft 321, namely away from the drive unit. The outer edge of the screw 324 extends clockwise from the free end of the shaft 321, i.e., the free end 362 of the rotor 32, toward the supported end 361 of the rotor 32 near the motor 31. In other words, the screw 324 is inclined in the same direction as the blades 323 with respect to the circumferential direction. The diameter of the inner circumferential surface 34 of the ejecting unit 14 shown in FIG. 6 is gradually reduced toward the ejection hole 21, namely away from the drive unit. The ejecting unit 14 covers the outer periphery of the screw 324 arranged at the free end 362 of the rotor 32. The inner circumferential surface 34 of the ejecting unit 14 will be referred to as "conical inner circumferential surface" herein below. The outer edge of the screw 324 is adjacent to the conical inner circumferential surface 34.

As shown in FIGS. 8 and 9, a notch 42 is formed in the portion of the screw 324 nearest to the blades 323. The outer diameter of the screw 324 is reduced in the portion where the notch 42 exists. The portion of the screw 324 where the notch 42 exists is positioned within the mixing chamber 13. As will be described later, the screw 324 serves to push out the clay from the ejection hole 21.

On the other hand, the arms 322 and the blades 323 serve to mix the clay within the mixing chamber 13. Other configurations than the screw 324 may be added in order to push out the clay. The parts or components having the clay push-out function will be collectively referred to as "extruding member 372" herein below. Likewise, other configurations than the arms 322 and the blades 323 may be added in order to mix the clay. The parts or components having the clay mixing function will be collectively referred to as "mixing member 371" herein below. The extruding member 372 is arranged at the free end of the shaft 321. The mixing member 371 is arranged nearer to the supported end 361 of the shaft 321 than the extruding member 372.

Figure 10:
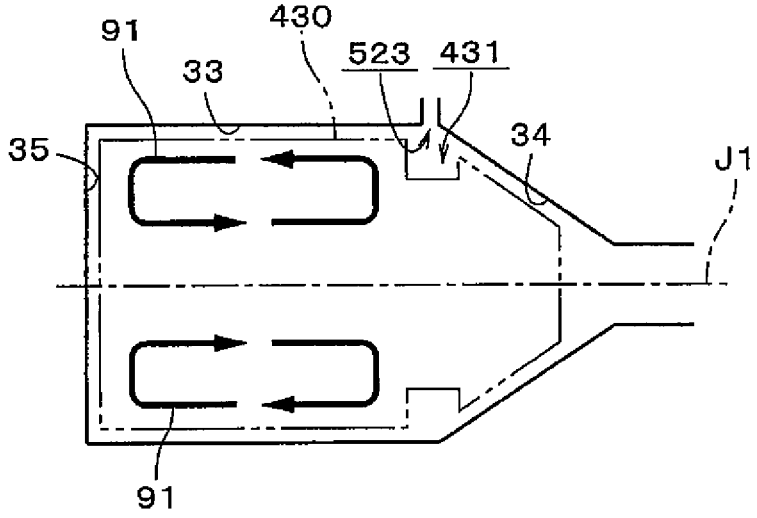
FIG. 10 is a schematic diagram depicting the rotation trajectory of the rotor.

The existence extent of the screw 324 and the existence extent of the blade 323 nearest to the screw 324 are continuous in the axial direction. In other words, the ejection-hole-side end portion of the blade 323 nearest to the screw 324 is positioned closer to the ejection hole 21 than the end portion of the screw 324 nearest to the motor 31. Thus the outer circumferential surface of the rotation trajectory of the rotor 32 is continuous in the axial direction. FIG. 10 is a schematic diagram depicting the cylindrical inner circumferential surface 33, the conical inner circumferential surface 34 and the rotation trajectory of the mixing member 371 and the extruding member 372. As depicted in FIG. 10, the outer circumferential surface 430 of the rotation trajectory is adjacent to the cylindrical inner circumferential surface 33 and the conical inner circumferential surface 34 in the positions other than the position where the notch 42 exists.

As shown in FIG. 6, the supported end 361 of the rotor is positioned within the mixing chamber 13. The rotation shaft 311 of the motor 31 protrudes into the mixing chamber 13 with a packing or the like fitted thereto. The supported end 361 of the rotor 32 is fixed to the protruding portion of the rotation shaft 311 by use of bolts or the like. The free end 362 of the rotor 32 is not supported and is opposed to the ejection hole 21. With the clay mixing apparatus 1 of this structure, it is possible to easily remove the rotor 32 from the motor 31 within the mixing chamber 13 during a maintenance and repair process, while preventing a seal structure such as a packing or the like existing between the motor 31 and the mixing chamber 13 from being damaged in the removal process of the rotor 32. Moreover, it is possible in the clay mixing apparatus 1 to detach the ejecting unit 14 from the mixing chamber 13. This makes it possible to easily clean the interior of the mixing chamber 13 without having to detach the mixing chamber 13.

Next, description will be made on the operation of the clay mixing apparatus 1. First, the body lid 131 for closing a supply hole 133 is opened as shown in FIG. 5. Clay or a clay material and water are supplied into the mixing chamber 13 through the supply hole 133. The clay material is not limited to a powdery material but may be clay-dissolved muddy water generated when manufacturing a piece of earthenware or dry clay left alone for a long time. It may be possible to initially supply dry clay into the mixing chamber 13 and then pulverize the dry clay within the mixing chamber 13, after which water may be supplied into the mixing chamber 13. In this manner, the clay mixing apparatus 1 can be used as a clay regenerator.

If the supply of clay is finished, the body lid 131 is closed and the operation unit 12 is operated to rotate the rotor 32. When seen at the side of the ejection hole 21, the rotor 32 is rotated counterclockwise. The blades 323 apply forces to the clay so that the clay is moved toward a wall 35 (see FIG. 10) on the side of the motor 31 within the mixing chamber 13. Consequently, as indicated by arrows 91 in FIG. 10, the clay is moved toward the motor-side wall 35 along the cylindrical inner circumferential surface 33, then moved from the wall 35 toward the center axis J1 and then moved toward the free end 362 of the shaft 321 through between the shaft 321 and the blades 323. However, the arrows 91 are nothing but to schematically illustrate the overall movement of the clay. In reality, the clay is mixed and mixed in a complicated fashion within the mixing chamber 13. The vane portion 325 provided at the supported end 361 of the rotor 32 serves to restrain the clay from adhering to the wall 35, thereby assuring a smooth mixing operation.

If a specified time lapses from the mixing startup time, the vacuum pump 27 is operated to depressurize the inside of the mixing chamber 13 and the ejecting unit 14. At this time, the ejection hole 21 is kept closed by a separately prepared cap. As stated earlier, the blades 323 have a plurality of through-holes 41. During the mixing process, the clay is moved through the through-holes 41 and is finely cut. This assists in efficiently removing the air contained in the clay.

Prior to depressurization, the rotor 32 is stopped and the body lid 131 is opened to observe the appearance of the clay passing through the blades 323. This makes it possible to easily confirm the state of the clay. More specifically, if the mixing of the clay is insufficient, the clay fails to pass through the through-holes 41. When sufficiently mixed, the clay passes through the through-holes 41 and has a string-like shape. This makes it possible to grasp the degree of softness of the clay.

Once the mixing is performed for a specified time under a reduced pressure, the rotating direction of the rotor 32 is reversed. After subjected to degassing, the clay is moved toward the screw 324 by the blades 323 and is molded and ejected from the ejection hole 21 by the screw 324 and the ejection tip end portion 142. The cap is pushed by the ejected clay and is removed from the ejection hole 21. Since the rotor 32 is rotated in the opposite directions during the mixing process and the ejecting process, it is possible to restrain the clay from staying within the ejecting unit 14 during the mixing process. As set forth above, the axial existence extents of the blades 323 and the screw 324 overlap with each other and, therefore, the outer circumferential surface 430 of the rotation trajectory of the rotor 32 is continuous in the axial direction. This makes it possible to reduce the quantity of the clay remaining within the mixing chamber 13 after ejection.

Figure 11:
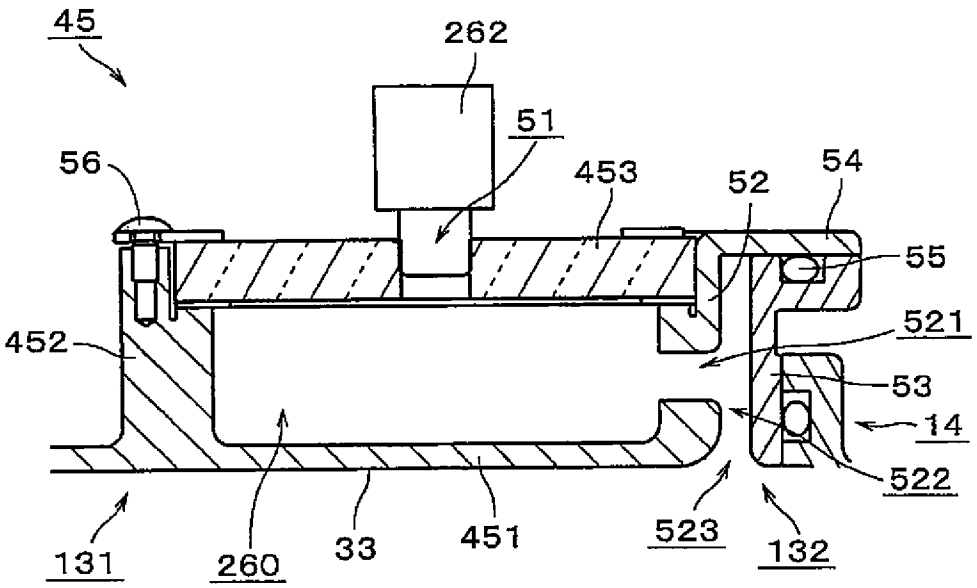
FIG. 11 is a section view showing an intermediate chamber and its vicinities.

Next, description will be made on the configuration relating to the depressurization of the clay mixing apparatus 1. As described above, the vacuum pump 27 is indirectly connected to the body lid 131. As shown in FIGS. 2 and 6, an intermediate chamber 45 is provided in the connection position where the vacuum pump 27 and the body lid 131 are connected to each other. FIG. 11 is a section view showing the intermediate chamber 45 and its vicinities on an enlarged scale. The intermediate chamber 45 preferably includes a bottom portion 451, a peripheral wall portion 452 and a cover portion 453. The bottom portion 451 is a portion making up the cylindrical inner circumferential surface 33 in the body lid 131. The peripheral wall portion 452 has a substantially rectangular shape when seen in a plan view and extends upward from the bottom portion 451. The cover portion 453 may preferably be a transparent plate member made of a acryl resin. A through-hole 51 is defined at the center of the cover portion 453. A connection portion 262 is fitted to the through-hole 51.

Exhaust holes 521 (only one of which is shown in FIG. 11) are defined in the ejecting-unit-side portion 52 of the peripheral wall portion 452. The portion 52 will be referred to as "front wall portion" herein below. The mixing chamber body 132 preferably includes a wall portion 53 opposing to the front wall portion 52. A flange 54 is formed along the entire perimeter of the body lid 131. A portion of the flange 54 extends from the upper end of the front wall portion 52 toward the ejecting unit 14. A packing 55 is arranged between the flange 54 and the mixing chamber body 132. The gap 522 between the front wall portion 52 and the wall portion 53 is opened toward the cylindrical inner circumferential surface 33. The opening 523 of the gap 522 defined on the cylindrical inner circumferential surface 33 will be referred to as "exhaust opening" herein below.

In other words, the gap 522 extends upward from the exhaust opening 523. The upper end of the gap 522 is closed by the flange 54. The portions defining the gap 522, the portions defining the exhaust holes 521, the intermediate chamber 45, the joint portion 262, the tube 263 and the vacuum gauge 26 make up an exhaust flow path 260 through which the exhaust opening 523 is connected to the vacuum pump 27.

As shown in FIG. 5, the exhaust holes 521 are defined in the front wall portion 52. The total sum of the flow path areas of the exhaust holes 521 is smaller than the flow path area of the gap 522. The term "flow path area" used herein refers to the cross-sectional area of a flow path in the direction perpendicular to the air flow direction. The flow path area in the intermediate chamber 45 is greater than the total sum of the flow path areas of the exhaust holes 521. Accordingly, even if the clay penetrates into the gap 522 and enters the exhaust holes 521, the clay stays within the intermediate chamber 45 and does not enter the joint portion 262. The cover portion 453 can be removed or opened from the body lid 131 by loosening screws 56. Thus the clay entering the intermediate chamber 45 can be removed with ease. Since the cover portion 453 is transparent, it is possible to easily confirm whether the clay has entered the intermediate chamber 45.

Inasmuch as the number of the exhaust holes 521 is plural, it is possible to reduce the possibility that the exhaust flow path 260 is closed in the exhaust holes 521. Since the gap 522 is defined between the body lid 131 and the mixing chamber body 132, the clay entering the gap 522 can be removed with ease by opening the body lid 131 as shown in FIG. 5. Owing to the fact that the exhaust holes 521 are defined in front wall portion 52, the exhaust holes 521 can be exposed by opening the body lid 131. This makes it possible to easily remove the clay filled in the exhaust holes 521.

As described with reference to FIG. 10, the portion 431 spaced apart from the cylindrical inner circumferential surface 33 is formed on the outer circumferential surface 430 of the rotation trajectory of the rotor 32. The existence extent of the portion 431, i.e., the axial existence extent of the notch 42 of the screw 324, covers the axial existence extent of the exhaust opening 523.

In other words, the end portion of the screw 324 lying at the side of the mixing member 371 is positioned below the exhaust opening 523. Due to the formation of the notch 42, the outer peripheral portion of the screw 324 is spaced apart from the cylindrical inner circumferential surface 33. This restrains the rotor 32 from pushing the clay into the exhaust opening 523. As a result, it is possible to easily reduce the pressure within the mixing chamber 13 and the ejecting unit 14. The outer circumferential surface 430 is adjacent to the cylindrical inner circumferential surface 33 and the conical inner circumferential surface 34 in the positions other than the position of the exhaust opening 523 along the center axis direction. Accordingly, it is possible to minimize the influence of the notch 42 on the mixing and ejecting operations.

Figure 12:
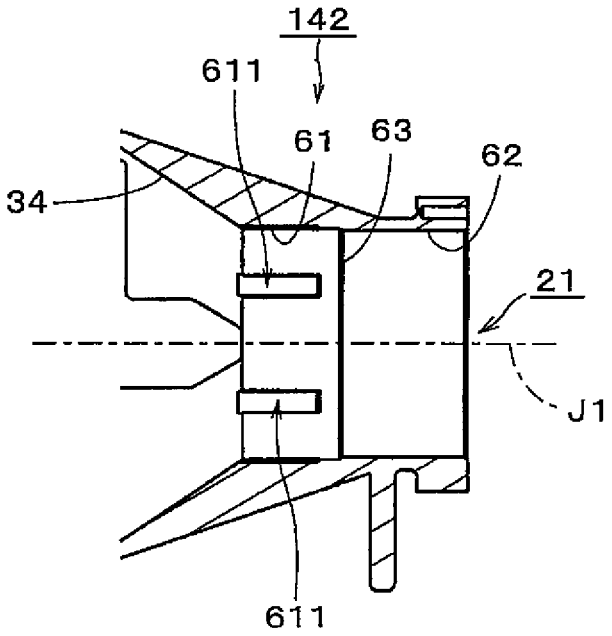
FIG. 12 is a section view showing an ejection tip end portion.

Next, description will be made on the structure of the ejection tip end portion 142. FIG. 12 is a section view showing the ejection tip end portion 142 on an enlarged scale. The ejection tip end portion 142 preferably includes a first clay-ejecting inner circumferential surface 61 and a second clay-ejecting inner circumferential surface 62. The first clay-ejecting inner circumferential surface 61 extends from the conical inner circumferential surface 34 toward the ejection hole 21 and has a substantially cylindrical shape about the center axis J1. The second clay-ejecting inner circumferential surface 62 extends from the first clay-ejecting inner circumferential surface 61 toward the ejection hole 21 and terminates at the ejection hole 21. In other words, the second clay-ejecting inner circumferential surface 62 is positioned between the first clay-ejecting inner circumferential surface 61 and the ejection hole 21. The second clay-ejecting inner circumferential surface 62 has a cylindrical shape.

The first clay-ejecting inner circumferential surface 61 preferably includes a plurality of recess portions 611 arranged along the circumferential direction. Each of the recess portions 611 extends substantially parallel to the center axis J1. The recess portions 611 extend from the conical inner circumferential surface 34 to the vicinity of the border 63 between the first clay-ejecting inner circumferential surface 61 and the second clay-ejecting inner circumferential surface 62. The recess portions 611 are spaced apart from the border 63.

In the present embodiment, the clay mixing apparatus 1 is provided with one rotor 32 and the clay is ejected along the center axis J1. For that reason, the clay tends to be distorted by the rotational force applied to the clay during the ejecting process. However, the recess portions 611 act against the rotation of the clay, thereby reducing distortion of the clay. This effect becomes more remarkable because the recess portions 611 are connected to the conical inner circumferential surface 34. In order to further reduce the distortion of the clay, the surface roughness of the first clay-ejecting inner circumferential surface 61 is set greater than the surface roughness of the second clay-ejecting inner circumferential surface 62. In other words, the first clay-ejecting inner circumferential surface 61 is roughly finished on purpose.

The innermost diameter of the first clay-ejecting inner circumferential surface 61 is set greater than the inner diameter of the second clay-ejecting inner circumferential surface 62. This makes it possible to restrain the corrugation of the first clay-ejecting inner circumferential surface 61 from being transferred to the ejected clay.

Raised portions may be provided in place of the recess portions 611. In this case, it is preferred that the raised portions extend from the conical inner circumferential surface 34 toward the ejection hole 21. Since the first clay-ejecting inner circumferential surface 61 is corrugated along the circumferential direction, it is possible to reduce distortion of the ejected clay. In case of providing the raised portions, it is preferred that the distance from the center axis J1 to the raised portions be equal to or greater than the inner diameter of the second clay-ejecting inner circumferential surface 62. This makes it possible to restrain the marks of the corrugation of the first clay-ejecting inner circumferential surface 61 from appearing in the ejected clay.

Generally speaking, the innermost diameter of the first clay-ejecting inner circumferential surface 61 is preferably equal to or greater than the inner diameter of the second clay-ejecting inner circumferential surface 62 and more preferably greater than the inner diameter of the second clay-ejecting inner circumferential surface 62.

The inner diameter of the first and second clay-ejecting inner circumferential surfaces 61 and 62 is not necessarily constant but may be slightly reduced toward the ejection hole 21. In this case, the inner diameter of the second clay-ejecting inner circumferential surface 62 compared with the innermost diameter of the first clay-ejecting inner circumferential surface 61 denotes the diameter measured in the border 63 between the first clay-ejecting inner circumferential surface 61 and the second clay-ejecting inner circumferential surface 62.

While one embodiment of the present invention has been described above, the present invention is not limited to the foregoing embodiment but may be modified in many different forms.

The cylindrical inner circumferential surface 33 need not be necessarily a perfect cylindrical surface. If the cylindrical inner circumferential surface 33 have a substantially cylindrical shape, it becomes possible to reduce the size of the clay mixing apparatus 1. In addition, the mixing operation can be smoothly performed if the cylindrical inner circumferential surface 33 is formed into a substantially cylindrical shape. For example, the cross section of the cylindrical inner circumferential surface 33 may have a substantially U-like shape. A space may be provided above the mixing member 371 and between the mixing member 371 and the cylindrical inner circumferential surface 33. The conical inner circumferential surface 34 needs only to be a substantially conical surface and may be, e.g., a flat conical surface whose horizontal width perpendicular to the center axis J1 is larger than the vertical width thereof.

Figure 13:
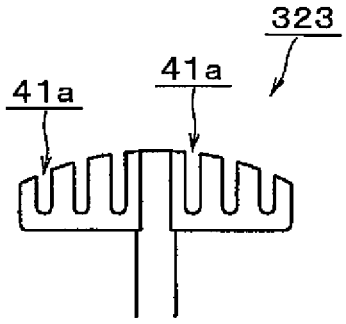
FIG. 13 is a view showing another example of a blade.

The blades 323 may be connected to one another. In other words, the mixing member 371 needs only to have a portion that can be substantially regarded as a plurality of blades. As shown in FIG. 13, the blades 323 may have a plurality of slits 41*a* in place of the through-holes 41. The blades 323 need not necessarily extend toward the opposite sides of each of the arms 322 but may extend toward one side thereof.

Figure 14:
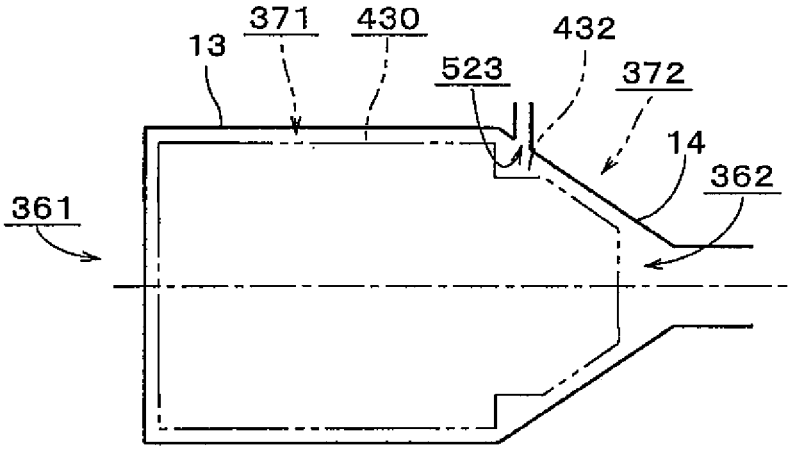
FIG. 14 is a schematic diagram depicting another example of the rotation trajectory of the rotor.

The screw 324 may have a shape other than the notch 42. For example, the end portion of the screw 324 lying at the side of the mixing member 371 may have a substantially constant outer diameter. In this case, as shown in FIG. 14, the outer diameter of the outer circumferential surface 430 of the rotation trajectory of the rotor 32 is gradually increased from the free end 362 of the rotor 32 toward the supported end 361 thereof and is kept constant in the portion 432. Then, the outer diameter of the outer circumferential surface 430 is increased again in the border between the mixing member 371 and the extruding member 372. In FIG. 14, the exhaust opening 523 is defined in the ejecting unit 14 near the mixing chamber 13. Since the screw 324 has a portion constant in outer diameter, the outer circumferential surface 430 grows distant from the exhaust opening 523 in the position where the exhaust opening 523 exists.

The outer circumferential surface 430 may be partially spaced apart from the cylindrical inner circumferential surface 33 and the conical inner circumferential surface 34 in the position distant from the exhaust opening 523. Generally speaking, the outer circumferential surface 430 of the rotation trajectory of the rotor 32 is more distant from the cylindrical inner circumferential surface 33 and/or the conical inner circumferential surface 34 in the position of the exhaust opening 523 than in the positions deviated from the exhaust opening 523 toward the supported end 361 and the free end 362 of the rotor 32. This makes it possible to restrain the clay from being filled into the exhaust opening 523.

Instead of providing the notch 42 in the screw 324, a notch may be formed in one of the blades 323. Generally speaking, the exhaust opening 523 is opposed, in a radial direction about the center axis, to a portion of the mixing member 371 lying near the extruding member 372 and/or a portion of the extruding member 372 lying near the mixing member 371. In order to reduce the manufacturing cost of the rotor 32, it is however preferred that all the blades 323 have a substantially identical shape and further that the outer circumferential surface 430 of the rotation trajectory be kept distant from the exhaust opening 523 by deforming the screw 324.

The axial existence extents of the mixing member 371 and the extruding member 372 may be non-continuous in the axial direction. In this case, the exhaust opening 523 is positioned in the position where the axial existence extents of the mixing member 371 and the extruding member 372 are non-continuous.

If the quantity of the supplied clay is small, the entire outer circumferential surface 430 of the rotation trajectory of the rotor 32 may be positioned adjacent to the cylindrical inner circumferential surface 33 and the conical inner circumferential surface 34. In other words, the notch 42 may be omitted from the screw 324. Even in this case, the exhaust opening 523 is positioned near the border between the mixing chamber 13 and the ejecting unit 14. It is therefore possible to restrain the clay from entering the exhaust opening 523 and to easily reduce the internal pressure of the mixing chamber 13. The exhaust opening 523 need not be necessarily formed above the mixing chamber 13 or the ejecting unit 14 but may be arranged in the lateral portion or the lower portion thereof.

The intermediate chamber 45 may be arranged in a position other than the body lid 131. For example, a tube may be connected to the exhaust holes 521 and an intermediate chamber independent from the body lid 131 may be arranged in the tube. The cover portion 453 of the intermediate chamber 45 may be opaque. In this case, it is necessary to, before the operation of the clay mixing apparatus 1, confirm whether the intermediate chamber 45 is filled with the clay. The exhaust holes 521 may be directly opened on the cylindrical inner circumferential surface 33 or the conical inner circumferential surface 34. In this case, the exhaust holes 521 serve as the exhaust opening 523. The gap 522 may be defined between the front wall portion 52 and the ejecting unit 14. In other words, a portion of the mixing chamber body 132 may not exist between the front wall portion 52 and the ejecting unit 14.

The technology of reducing distortion of the ejected clay can be used in clay mixing apparatus having mixing members of other different shapes. For example, the technology of reducing distortion of the ejected clay can find its application in a clay mixing apparatus having no reverse rotation function, a clay mixing apparatus having no pressure reduction function and a clay mixing apparatus in which the mixing member and the ejecting unit are formed of a single screw.

The first clay-ejecting inner circumferential surface 61 and the second clay-ejecting inner circumferential surface 62 may have the same innermost diameter. In this case, the border 63 between the first and second clay-ejecting inner circumferential surfaces 61 and 62 may be arbitrarily decided. The recess portions 611 or the raised portions formed on the first clay-ejecting inner circumferential surface 61 need not be necessarily kept perfectly parallel to the center axis J1.

The configurations of the embodiment and the modified examples described above may be arbitrarily combined unless contradictory to one another.

The clay mixing apparatus according to the present invention can be used in mixing (and molding) various kinds of clay or a material that can be regarded as clay. In addition, the clay mixing apparatus can be used in regenerating waste clay generated in a clay using process.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A clay mixing apparatus, comprising:

a mixing chamber having a substantially cylindrical inner circumferential surface, the mixing chamber having a center axis extending in a horizontal direction;

a rotor arranged within the mixing chamber, the rotor having a first end portion as a supported end portion and a second end portion positioned opposite to each other in a direction along the center axis;

a drive unit connected to the first end portion of the rotor, the drive unit serving to rotate the rotor about the center axis;

an ejecting unit arranged to surround the second end portion of the rotor, the ejecting unit having a conical inner circumferential surface whose diameter is reduced away from the drive unit, the ejecting unit having an ejection hole defined at a tip end thereof;

a pressure reducing unit; and an exhaust flow path arranged to connect the pressure reducing unit to an exhaust opening opened into the mixing chamber, wherein the rotor includes a shaft arranged to extend along the center axis and rotated by the drive unit, an extruding member arranged on the shaft in the second end portion of the rotor and provided with a screw inclined in a slanted direction with respect to a circumferential direction about the center axis and a mixing member arranged on the shaft between the extruding member and the first end portion of the rotor, the mixing member includes a plurality of arms extending from the shaft toward the cylindrical inner circumferential surface and a plurality of blades arranged at tip ends of the arms and inclined in the slanted direction with respect to the circumferential direction, the exhaust opening is opposed, in a radial direction about the center axis, to a portion of the mixing member lying near the extruding member and/or a portion of the extruding member lying near the mixing member, and an outer circumferential surface of a rotation trajectory of the rotor is more distant from the cylindrical inner circumferential surface and/or the conical inner circumferential surface in the position of the exhaust opening than in the positions deviated from the exhaust opening toward the first end portion and the second end portion of the rotor.

2. The clay mixing apparatus of claim 1, wherein the outer circumferential surface of the rotation trajectory is continuous in the center axis direction and is adjacent to the cylindrical inner circumferential surface and the conical inner circumferential surface in the positions other than the position of the exhaust opening along the center axis direction.

3. The clay mixing apparatus of claim 1, wherein an outer circumferential surface of a rotation trajectory of the rotor is continuous in the center axis direction and is adjacent to the cylindrical inner circumferential surface and the conical inner circumferential surface in the positions other than the position of the exhaust opening along the center axis direction.

4. The clay mixing apparatus of claim 1, wherein the exhaust flow path includes an intermediate chamber having an openable cover portion.

5. The clay mixing apparatus of claim 4, wherein the cover portion is transparent.

6. The clay mixing apparatus of claim 1, wherein the mixing chamber includes a mixing chamber body having an upper supply hole, and a body lid arranged to cover the supply hole, the body lid having a wall portion positioned near the ejecting unit such that a gap extending upward from the exhaust opening is defined between the wall portion of the body lid and the mixing chamber body or the ejecting unit, the exhaust flow path including one or more exhaust holes defined in the wall portion of the body lid.

7. The clay mixing apparatus of claim 6, wherein the exhaust holes are provided in plural.

8. The clay mixing apparatus of claim 1, wherein the screw has a mixing-member-side end portion positioned below the exhaust opening, the mixing-member-side end portion having an outer peripheral portion spaced apart from the cylindrical inner circumferential surface.

9. The clay mixing apparatus of claim 1, wherein the rotor and the drive unit are detachable from each other within the mixing chamber.

10. A clay mixing apparatus, comprising:

a mixing chamber having a substantially cylindrical inner circumferential surface, the clay mixing apparatus having a center axis extending in a horizontal direction;

a rotor arranged within the mixing chamber, the rotor having a supported end portion in a direction along the center axis;

a drive unit connected to the supported end portion of the rotor, the drive unit serving to rotate the rotor about the center axis;

a pressure reducing unit; and an exhaust flow path arranged to interconnect the mixing chamber and the pressure reducing unit, wherein the rotor includes a shaft arranged to extend along the center axis and rotated by the drive unit and a mixing member arranged on the shaft, the mixing member includes a plurality of arms extending from the shaft toward the cylindrical inner circumferential surface and a plurality of blades arranged at tip ends of the arms and inclined in a slanted direction with respect to the circumferential direction, and at least one of the blades has a plurality of through-holes or a plurality of slits through which clay passes during a mixing process.

11. A clay mixing apparatus, comprising:

a mixing chamber;

a rotor arranged within the mixing chamber, the rotor having a first end portion as a supported end portion and a second end portion positioned opposite to each other in a direction along a center axis of the mixing chamber;

a drive unit connected to the first end portion of the rotor, the drive unit serving to rotate the rotor about the center axis; and an ejecting unit arranged to surround the second end portion of the rotor, the ejecting unit having a conical inner circumferential surface whose diameter is reduced away from the drive unit, the ejecting unit having an ejection hole defined at a tip end thereof, wherein the rotor includes a shaft arranged to extend along the center axis and rotated by the drive unit, an extruding member arranged on the shaft in the second end portion of the rotor and provided with a screw inclined in a slanted direction with respect to a circumferential direction about the center axis and a mixing member arranged on the shaft between the extruding member and the first end portion of the rotor, the ejecting unit includes a first clay-ejecting inner circumferential surface extending from the conical inner circumferential surface toward the ejection hole and a second clay-ejecting inner circumferential surface positioned between the first clay-ejecting inner circumferential surface and the ejection hole, the first clay-ejecting inner circumferential surface includes a plurality of recess portions or raised portions extending parallel to the center axis and arranged along the circumferential direction, the first clay-ejecting inner circumferential surface has an innermost diameter equal to or greater than an inner diameter of the second clay-ejecting inner circumferential surface, and the screw is arranged axially away from the plurality of recess portions or raised portions such that the screw does not overlap radially with any of the plurality of recess portions or raised portions.

12. The clay mixing apparatus of claim 11, wherein the recess portions or the raised portions extend from the conical inner circumferential surface toward the ejection hole.

13. The clay mixing apparatus of claim 12, wherein the first clay-ejecting inner circumferential surface has the recess portions, the recess portions being spaced apart from a border between the first clay-ejecting inner circumferential surface and the second clay-ejecting inner circumferential surface.

14. The clay mixing apparatus of claim 11, wherein the first clay-ejecting inner circumferential surface has the recess portions, the recess portions being spaced apart from a border between the first clay-ejecting inner circumferential surface and the second clay-ejecting inner circumferential surface.

15. The clay mixing apparatus of claim 11, wherein the first clay-ejecting inner circumferential surface is greater in surface roughness than the second clay-ejecting inner circumferential surface.

16. The clay mixing apparatus of claim 1, wherein a notch is formed in a portion of the screw lying near the mixing member and an outer diameter of the screw is reduced in the portion where the notch is formed.

17. The clay mixing apparatus of claim 1, wherein one of the blades nearest to the screw includes an ejection hole side end portion which radially overlaps an end portion of the screw nearest to the drive unit.

18. The clay mixing apparatus of claim 10, wherein the exhaust flow path includes an intermediate chamber including an openable cover portion.

19. The clay mixing apparatus of claim 11, wherein the clay mixing apparatus further comprises a pressure reducing unit and an exhaust flow path arranged to interconnect the mixing chamber and the pressure reducing unit, and wherein the exhaust flow path includes an intermediate chamber including an openable cover portion.

20. The clay mixing apparatus of claim 10, wherein the plurality of slits are radially extending slits.

* * * * *